US007337717B2

(12) United States Patent
Chen

(10) Patent No.: US 7,337,717 B2
(45) Date of Patent: Mar. 4, 2008

(54) INK RESIDUE LIFTING AND TRANSFER MECHANISM FOR SCREEN PRINTING MACHINE

(75) Inventor: Tung Chin Chen, Taipei (TW)

(73) Assignee: Atma Champ Enterprise Corporation, Taipei (TW)

( * ) Notice: Subject to any disclaimer, the term of this patent is extended or adjusted under 35 U.S.C. 154(b) by 63 days.

(21) Appl. No.: 11/441,355

(22) Filed: May 26, 2006

(65) Prior Publication Data

US 2007/0272100 A1 Nov. 29, 2007

(51) Int. Cl.
*B41F 15/42* (2006.01)

(52) U.S. Cl. ..... 101/123; 101/114

(58) Field of Classification Search ..... 101/123, 101/126, 114, 129; 118/120
See application file for complete search history.

(56) References Cited

U.S. PATENT DOCUMENTS 3,731,623 A * 5/1973 Bubley et al. ..... 101/114
5,044,306 A * 9/1991 Erdmann ..... 118/120
5,953,986 A * 9/1999 Murakami ..... 101/123

FOREIGN PATENT DOCUMENTS

JP 61011255 A * 1/1986

* cited by examiner

*Primary Examiner*—Leslie J Evanisko
(74) *Attorney, Agent, or Firm*—Rabin & Berdo, PC

(57) ABSTRACT

An ink residue lifting and transfer mechanism is provided on a printing mechanism of a screen printing machine to pneumatically horizontally drive an ink reclaiming blade, so that the ink reclaiming blade is in complete contact with a scraper of the printing mechanism to hold ink residue after one printing in a space contained between the closely contacted scraper and the ink reclaiming blade, preventing the ink residue from dripping off from the scraper to the screen plate to smudge the printed object in the course of ink reclaiming. And, the ink residue is lifted and transferred by the closely contacted scraper and ink reclaiming blade to an initial position for reuse in the next printing without being wasted. Therefore, an improved accuracy of printing can be achieved at reduced cost.

8 Claims, 7 Drawing Sheets

INK RESIDUE LIFTING AND TRANSFER MECHANISM FOR SCREEN PRINTING MACHINE

FIELD OF THE INVENTION

The present invention relates to an ink residue lifting and transfer mechanism for screen printing machine, and more particularly to a driving unit that can be actuated in an ink reclaiming process after one printing on a screen printing machine to lift and transfer any ink residue from the screen plate to an initial position for the next printing, preventing the ink residue from smudging the printed object or being wasted.

BACKGROUND OF THE INVENTION

A cantilever-type screen printing machine is one of many important printing machines and is particularly suitable for precision printing on circuit boards. This type of screen printing machine typically includes a platform having an upper surface defining a printing bed, an elevating slide base provided to one lateral side of the platform, a transverse slide base mounted on the elevating slide base to move leftward and rightward, a cantilevered printing head including a scraper and an ink reclaiming blade forward extended from the transverse slide base and adapted to slide leftward and rightward, a cantilevered arm forward extended from each lateral side of the transverse slide base, and a clamping support provided at a lower side of each of the two cantilevered arms for holding a screen plate between the two cantilevered arms. When an object to be printed is positioned on the printing bed, the printing head is pneumatically or electrically driven to transversely move and scrape ink on the screen plate. At this point, the printing head produces a downward pressure, causing the ink to penetrate through the screen plate to the object to be printed and create a printing effect via patterns on the screen plate.

Currently, there are many different types of screen printing machines available in the market, including cantilever type, four-pillar type, electric type, electric vertical type, pneumatic type, etc. All these types of screen printing machines have generally the same printing head structure. When the screen printing machine operates, printing ink remained on the scraper of the printing head tends to drip down to the screen plate in the course of ink reclaiming, and would very possibly fall on are as of the screen plate that have not been scraped by the ink reclaiming blade to overflow into the printed object to result in uneven thickness or diffusion of the printing ink on the object and therefore adversely affect the printing accuracy and quality.

Moreover, in the conventional screen printing machine, it is impossible to reclaim some types of expensive printing ink, such as silver paste and magnetic induction ink, when the printing is completed. The expensive ink remains at peripheral are as of the screen plate and is unnecessarily wasted. There are also some special ink or screen plates that would cause overflow of ink below the screen plate in the course of reclaiming ink to adversely affect the printing quality.

In brief, in the conventional screen printing machine, there is not proper way for handling the ink residue in the course of ink reclaiming. The ink residue is allowed to overflow to the printed object, causing uneven thickness of ink on the printed object and poor printing quality. The expensive ink residue on the screen plate without being reclaimed forms an unnecessary waste in the printing. Moreover, the ink residue exposed to ambient environment over a prolonged time tends to become dried and degraded to reduce the printing quality, too.

SUMMARY OF THE INVENTION

A primary object of the present invention is to provide an ink residue lifting and transfer mechanism for screen printing machine, so as to solve the problem of ink residue dripped from the scraper to the screen plate during the process of ink reclaiming after one printing.

Another object of the present invention is to provide an ink residue lifting and transfer mechanism for screen printing machine, in which driving units are employed to enable the scraper and the ink reclaiming blade of the screen printing machine to closely contact with each other and define a receiving space between them in the course of ink reclaiming, so as to lift and transfer ink residue to an initial position for reuse in the next printing.

A further object of the present invention is to provide an ink residue lifting and transfer mechanism for screen printing machine, so as to achieve more accurate printing to meet the requirements in the high-precision manufacturing process of the high-tech photoelectric industry.

To achieve the above and other objects, the ink residue lifting and transfer mechanism for screen printing machine of the present invention is applicable to a printing mechanism of general screen printing machines. The printing mechanism is provided on a slide base transversely straddling a printing bed of the screen printing machine, and is movable to a predetermined position under control for printing. The slide base is provided at one side near each lateral end thereof with a first printing pressure cylinder, and at an opposite side near each lateral end thereof with a second printing pressure cylinder corresponding to the first printing pressure cylinder, and a scraper holder is assembled to a lower side of the two first printing pressure cylinders for holding a scraper thereto.

The ink residue lifting and transfer mechanism includes a first and a second driving unit separately assembled to a lower side of the two second printing pressure cylinders, and an ink reclaiming blade holding bar extended between the first and the second driving unit for holding an ink reclaiming blade to a lower side thereof.

The first driving unit includes an actuating cylinder screwed to a top of a lower base. The actuating cylinder is provided on one lateral side facing toward the second driving unit with a slide way, to which an angle scale holder is mounted for holding an angle scale thereto, and on an opposite lateral side with a universal joint and an air throttle valve, and the universal joint is provided at a top with a universal lever, and at a front side with a micrometer head. And, an upper base and a supporting plate are screwed to a top and a rear side of the actuating cylinder, respectively.

The second driving unit includes an actuating cylinder screwed to a top of a lower base. The actuating cylinder is provided on one lateral side facing toward the first driving unit with a slide way, to which an angle scale holder is mounted for holding an angle scale thereto, and on an opposite lateral side with a universal joint and an air throttle valve, and the universal joint is provided at a top with a universal lever, and at a front side with a micrometer head. And, an upper base and a supporting plate are screwed to a top and a rear side of the actuating cylinder, respectively.

The first and the second printing pressure cylinders are provided with an adjusting knob each for adjusting the depth of travel of the first and the second printing pressure cylinders.

In an embodiment of the present invention, the ink reclaiming blade holding bar is provided at two end surfaces with an insertion hole each.

In an operable embodiment of the present invention, the upper base of the first driving unit is provided at a predetermined position with a fixture for holding a shaft seat thereto.

In a preferred embodiment of the present invention, the upper base of the second driving unit is provided at a predetermined position with a fixture for holding a shaft seat thereto.

With the above arrangements, any ink residue after one printing could be pushed to a space between the scraper and the ink reclaiming blade, and the first and the second printing pressure cylinders could be adjusted in the depth of travel thereof, so that the ink residue can be lifted along with the scraper and the ink reclaiming blade and transferred to an initial position on the screen plate for use in the next printing without overflowing to adversely affect the even thickness of ink on the printed object. And, the reclaimed ink residue could be reused to reduce the printing cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
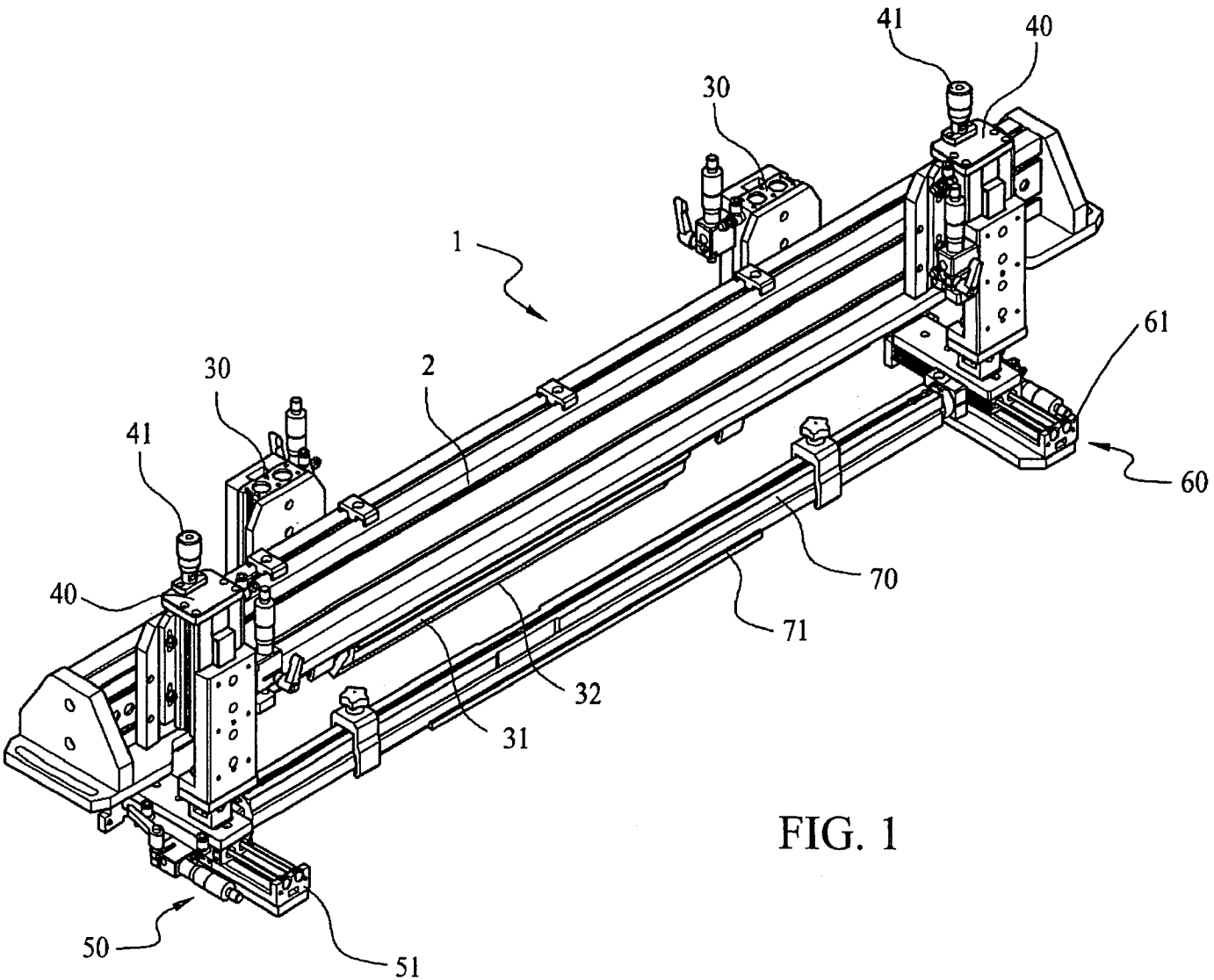
FIG. 1 is an assembled perspective view of an ink residue lifting and transfer mechanism for screen printing machine according to an embodiment of the present invention.
Figure 2:
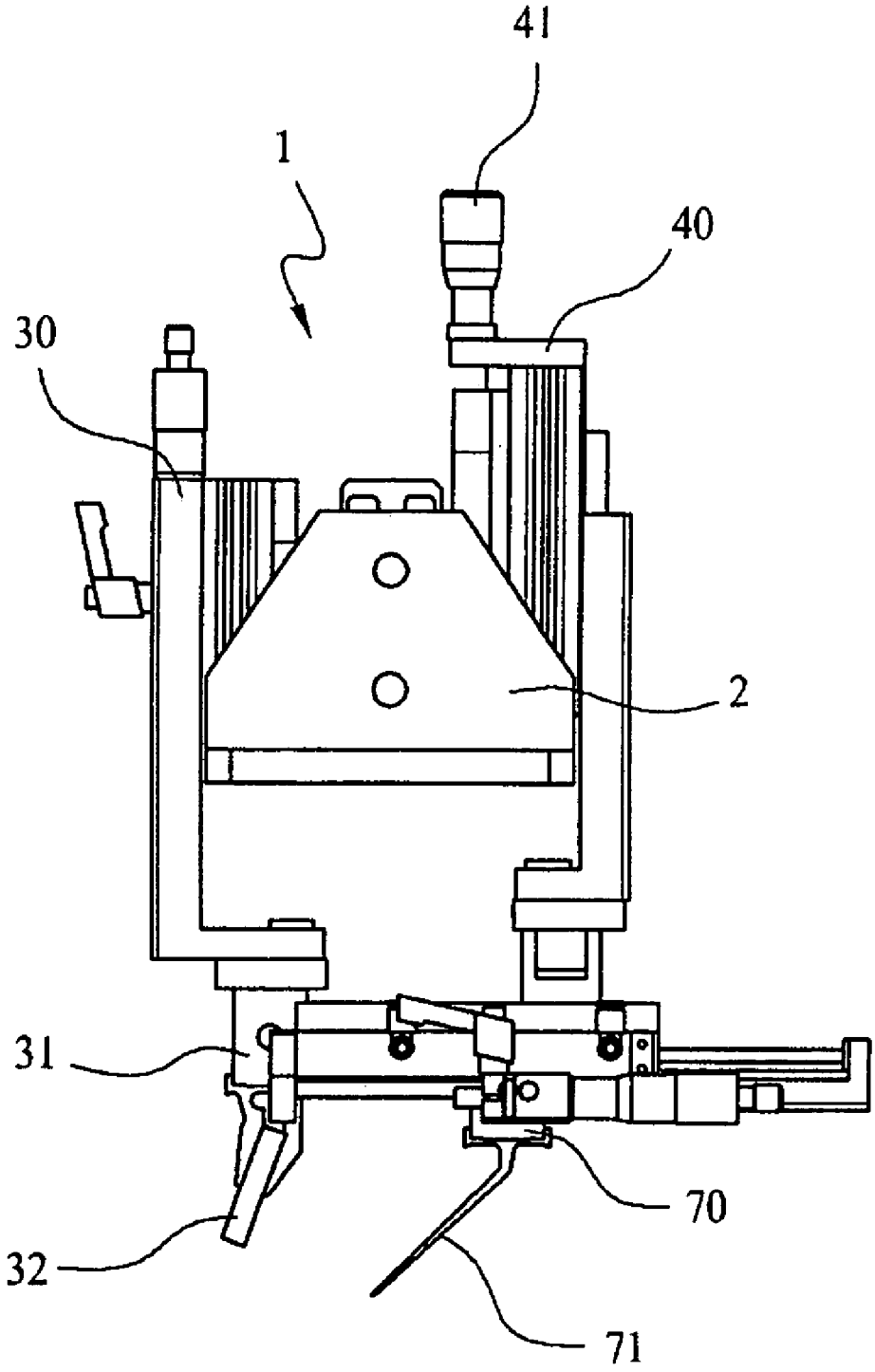
FIG. 2 is a side view of FIG. 1.

Please refer to FIGS. 1 to 4, in which an ink residue lifting and transfer mechanism for screen printing machine according to an embodiment of the present invention is shown. The ink residue lifting and transfer mechanism of the present invention is applicable to a printing mechanism 1 for general screen printing machines. The printing mechanism 1 is provided on a slide base 2, which transversely straddles a printing bed (not shown) of the screen printing machine, and can be moved to a predetermined position under control for printing.

In the above-mentioned printing mechanism 1, the slide base 2 is provided at one side near each lateral end thereof with a first printing pressure cylinder 30, and at an opposite side near each lateral end thereof with a second printing pressure cylinder 40 corresponding to the first printing pressure cylinder 30. A scraper holder 31 is assembled to a lower side of the two first printing pressure cylinders 30 for holding a scraper 32 thereto.

A first and a second driving unit 50, 60 are separately assembled to a lower side of the two second printing pressure cylinders 40. An ink reclaiming blade holding bar 70 is extended between the first and the second driving unit 50, 60 for holding an ink reclaiming blade 71 to a lower side thereof.

In an operable embodiment of the present invention, the first and the second printing pressure cylinder 30, 40 may be replaced with general cylinders or other vertically movable devices.

Generally, the scraper 32 and the ink reclaiming blade 71 have different up and down travel ranges, depending on actual printing requirements. When the scraper 32 and the ink reclaiming blade 71 are elevated at the same time to lift and transfer ink residue, there would be a height difference between the scraper 32 and the ink reclaiming blade 71, preventing the scraper 32 and the ink reclaiming blade 71 from completely closing to each other. As a result, ink residue carried by the scraper 32 and the ink reclaiming blade 71 would leak and drip from a gap between the scraper 32 and the ink reclaiming blade 71 down to a screen plate of the screen printing machine. To solve this problem, an adjusting knob is provided on each of the first and the second printing pressure cylinders 30, 40 as an aid to adjust the depth of travel of the first and the second printing pressure cylinders 30, 40, so that the scraper 32 and the ink reclaiming blade 71 are elevated at the same time to the same height. In the drawings, only the adjusting knobs 41 for the second printing pressure cylinders 40 are illustrated.

Figure 5:
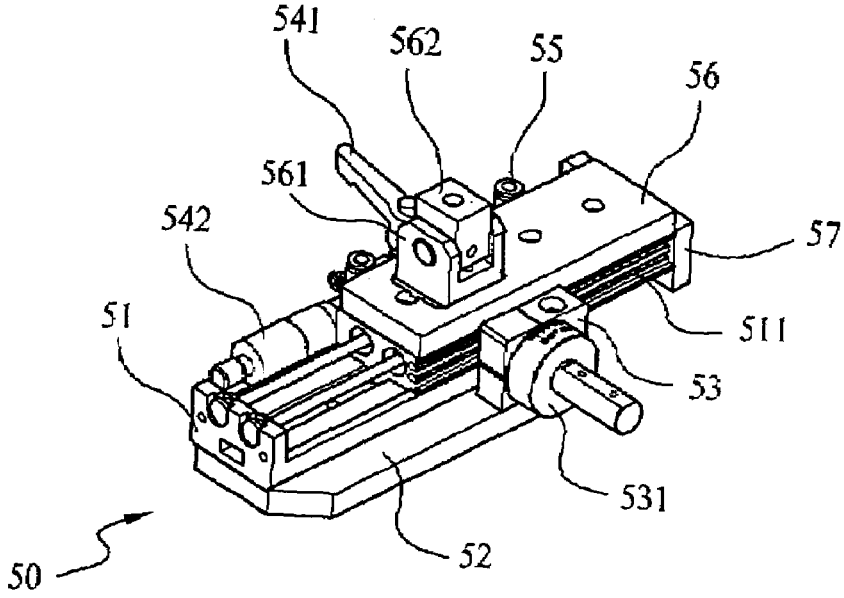
FIG. 5 is an assembled perspective view of a first driving unit included in the present invention.
Figure 6:
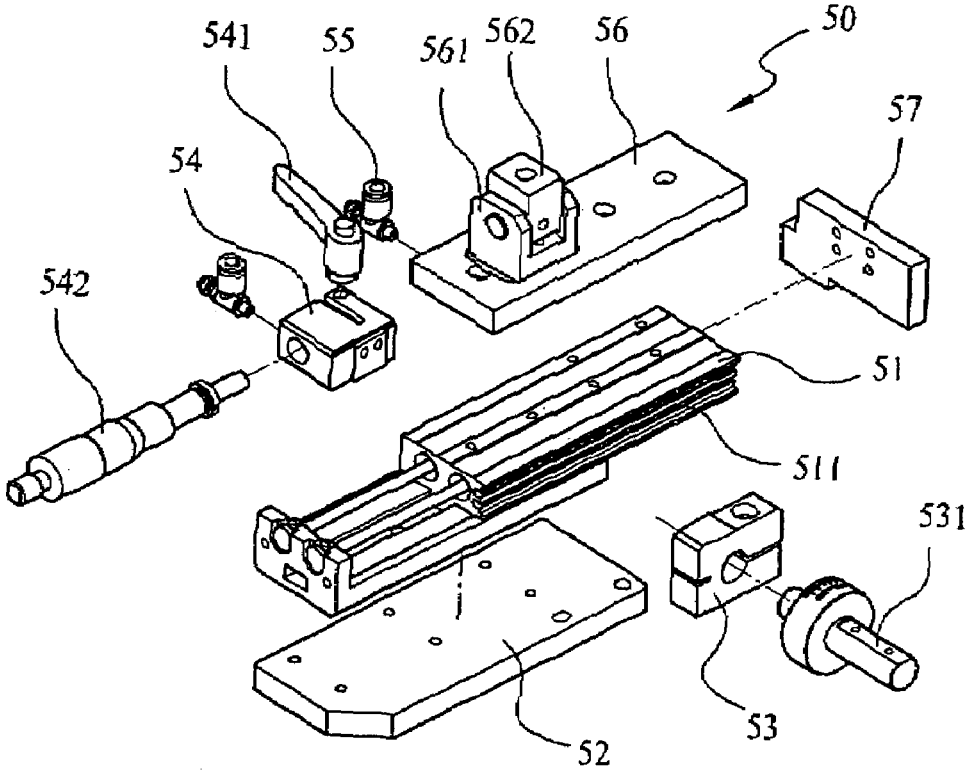
FIG. 6 is an exploded view of FIG. 5.

Please refer to FIGS. 5 and 6 that are assembled and exploded perspective views, respectively, of the first driving unit 50. As shown, the first driving unit 50 includes an actuating cylinder 51 screwed to a top of a lower base 52. The actuating cylinder 51 is provided on a right side, as viewed in front of the drawing, with a slide way 511, to which an angle scale holder 53 is mounted for holding an angle scale 531 thereto, and on a left side with a universal joint 54 and an air throttle valve 55. A universal lever 541 is connected at an inner end to a top of the universal joint 54, and a micrometer head 542 is assembled to a front side of the universal joint 54. An upper base 56 is screwed to a top of the actuating cylinder 51, and a supporting plate 57 is mounted to a rear side of the actuating cylinder 51.

Figure 7:
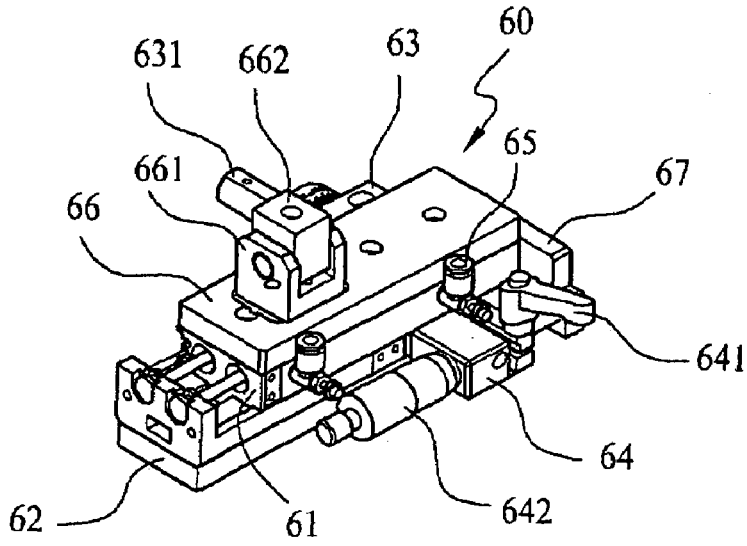
FIG. 7 is an assembled perspective view of a second driving unit included in the present invention.
Figure 8:
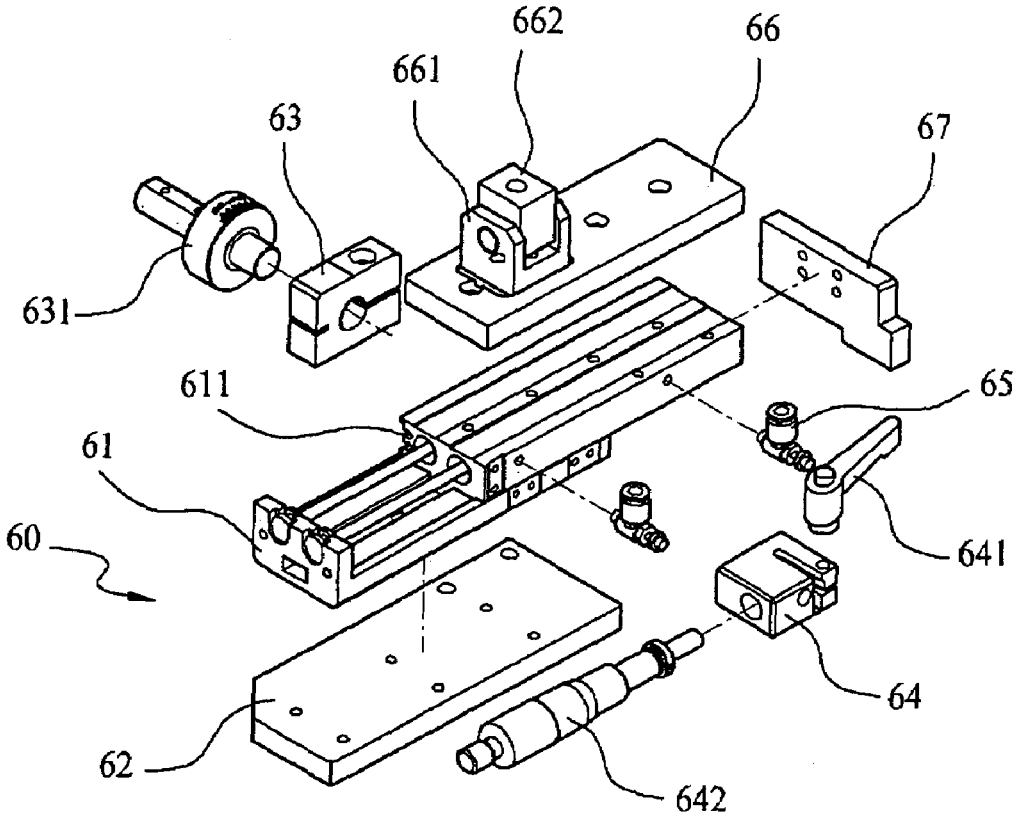
FIG. 8 is an exploded view of FIG. 7.
Figure 9:
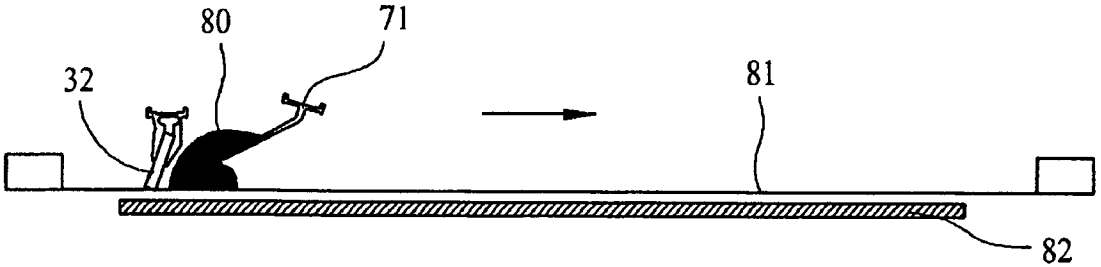
FIGS. 9 through 11 shows the operation of the present invention to lift and transfer ink residue on a screen printing machine.

Please refer to FIGS. 7 and 8 that are assembled and exploded perspective views, respectively, of the second driving unit 60. As shown, the second driving unit 60 includes an actuating cylinder 61 screwed to a top of a lower base 62. The actuating cylinder 61 is provided on a left side, as viewed in front of the drawing, with a slide way 611, to which an angle scale holder 63 is mounted for holding an angle scale 631 thereto, and on a right side with a universal joint 64 and an air throttle valve 65. A universal lever 641 is connected at an inner end to a top of the universal joint 64, and a micrometer head 642 is assembled to a front side of the universal joint 64. An upper base 66 is screwed to a top of the actuating cylinder 61, and a supporting plate 67 is mounted to a rear side of the actuating cylinder 61.

Figure 3:
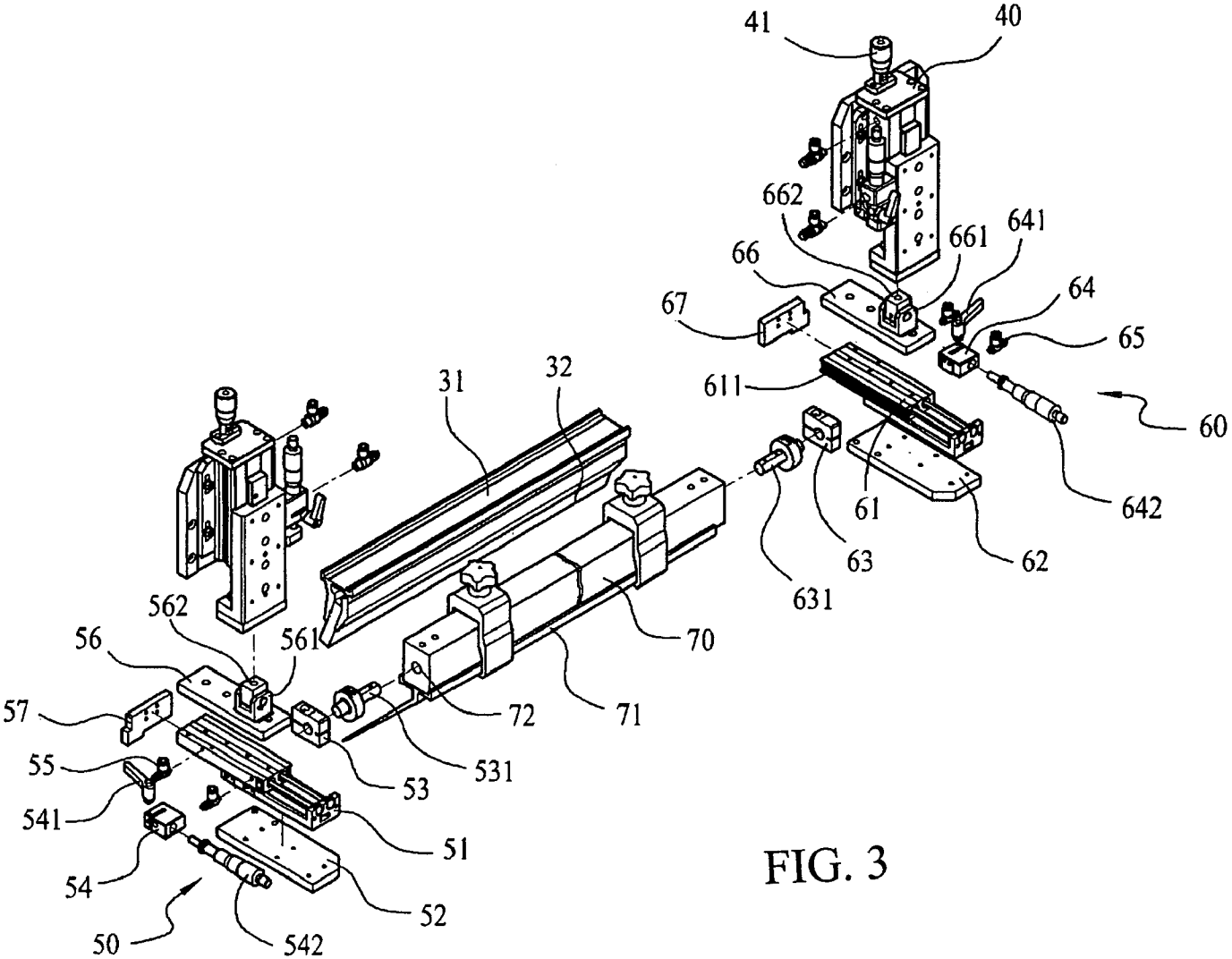
FIG. 3 is an exploded view of FIG. 1.
Figure 4:
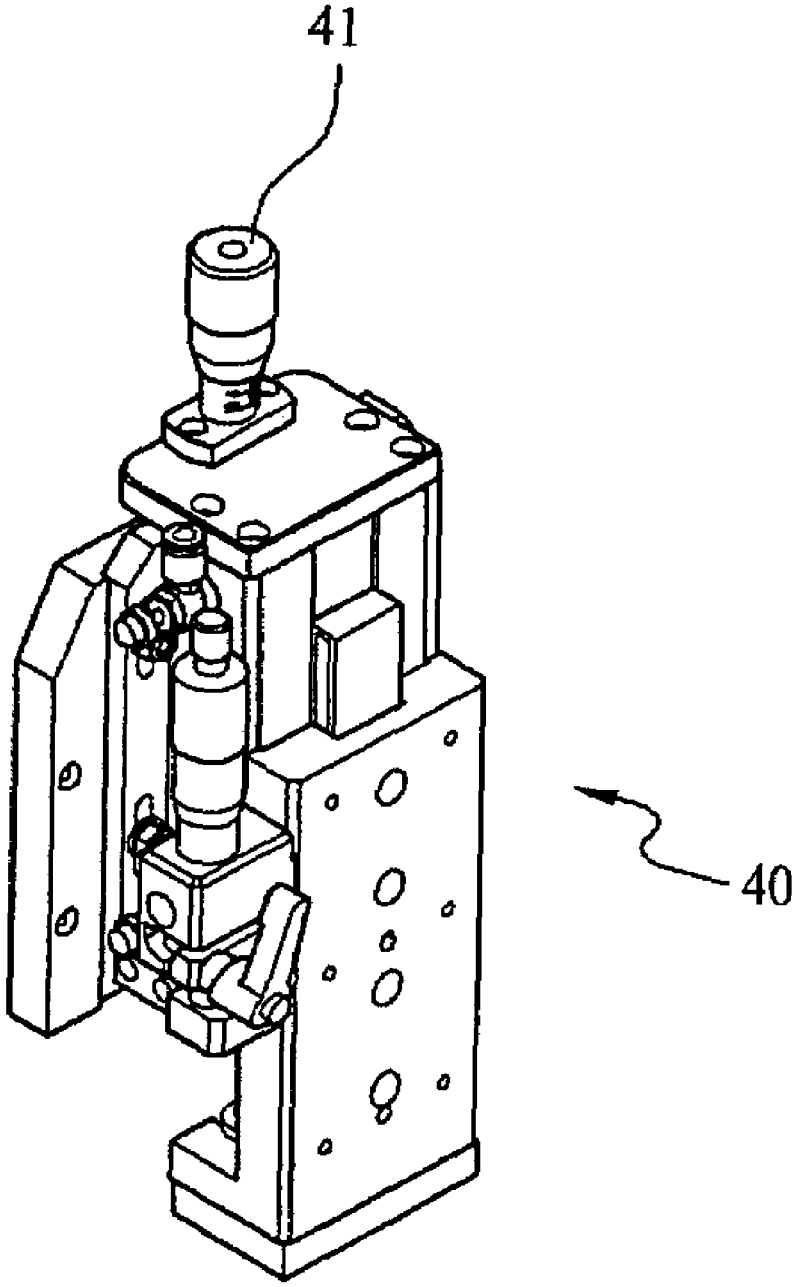
FIG. 4 is an assembled perspective view of a second printing pressure cylinder included in the present invention.

In the illustrated embodiment, as can be seen from FIG. 3, the ink reclaiming blade holder 70 is provided at two end surfaces with an insertion hole 72 each, to which the angle scales 531, 631 of the first and the second driving unit 50, 60, respectively, are connected.

The upper base 56 of the first driving unit 50 is provided at a predetermined position with a fixture 561 for holding a shaft seat 562 therein. Similarly, the upper base 66 of the second driving unit 60 is provided at a predetermined position with a fixture 661 for holding a shaft seat 662 therein.

Figure 10:
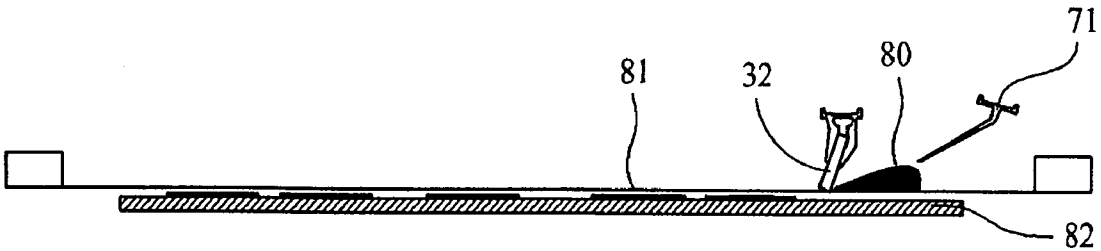
Figure 11:
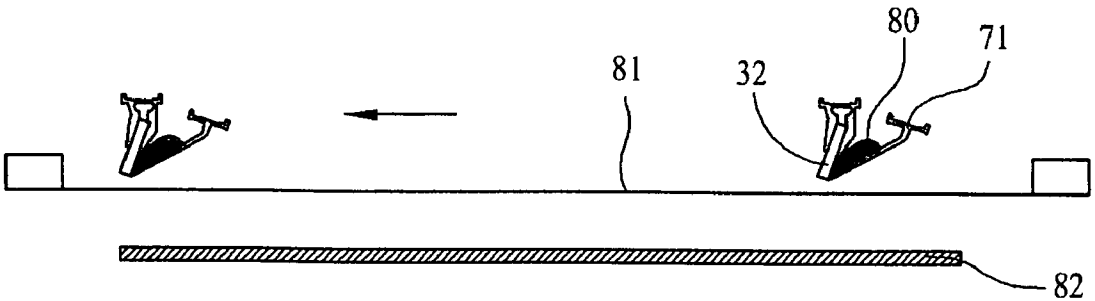

Please refer to FIGS. 1, 2, and 9 through 11. When the screen printing machine drives the printing mechanism 1 to print, the scraper 32 applies a downward printing pressure to a screen plate 81 of the screen printing machine, so that printing ink 80 on the screen plate 81 penetrates through patterns on the screen plate 81 to print on an object 82 to be printed, as shown in FIG. 10.

When the printing mechanism 1 starts reclaiming ink residue, the second printing pressure cylinders 40 on the slide base 2 are vertically lowered by a distance, so that the ink reclaiming blade 71 is in contact with a top surface of the screen plate 81. Then, the actuating cylinders 51, 61 of the first and the second driving unit 50, 60, respectively, are horizontally moved toward the scraper 32, so that a receiving space is formed between the ink reclaiming blade 71 and the scraper 32 to lift and hold the ink residue 80 therein. Meanwhile, printing ink 80 remained on the scraper 32 also drips down into the receiving space between the ink reclaiming blade 71 and the scraper 32 instead of dripping onto the screen plate 81.

When the printing mechanism 1 has been returned to its initial position for printing, the actuating cylinders 51, 61 of the first and the second driving unit 50, 60, respectively, are also returned to their initial position, so that ink residue 80 previously held in the receiving space is released to spread over the screen plate 81, and the ink reclaiming blade 71 is elevated to its initial position again. At this point, the slide base 2 would be slightly moved backward to prevent the ink residue 80 from diffusing to a rear side of the scraper 32 and not being reused in the next printing.

In some high precision manufacturing processes for ceramic capacitor, EL (electroluminescence) cold light strip, light guiding plate, etc. that require highly accurate printing using printing ink and silver gel having a relatively high viscosity, or require a special screen plate for printing, ink residue 80 tends to downward penetrate through the screen plate 81 at the time of ink reclaiming. With the ink residue lifting and transfer mechanism of the present invention, it is possible to solve the problem of downward penetrated ink residue and to control a uniform thickness of the printed film lower than 0.005 mm to meet the requirements of high-tech photoelectric industry.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An ink residue lifting and transfer mechanism applicable to a printing mechanism of general screen printing machines, said printing mechanism being provided on a slide base transversely straddling a printing bed of said screen printing machine, and being movable to a predetermined position under control for printing; said slide base being provided at one side near each lateral end thereof with a first printing pressure cylinder, and at an opposite side near each lateral end thereof with a second printing pressure cylinder corresponding to said first printing pressure cylinder, and a scraper holder being assembled to a lower side of said two first printing pressure cylinders for holding a scraper thereto; said ink residue lifting and transfer mechanism comprising:

a first and a second driving unit separately assembled to a lower side of said two second printing pressure cylinders, and an ink reclaiming blade holding bar extended between said first and said second driving unit for holding an ink reclaiming blade to a lower side thereof.

2. The ink residue lifting and transfer mechanism for screen printing machine as claimed in claim 1, wherein said first driving unit includes an actuating cylinder screwed to a top of a lower base; said actuating cylinder being provided on one lateral side facing toward said second driving unit with a slide way, to which an angle scale holder is mounted for holding an angle scale thereto, and on an opposite lateral side with a universal joint and an air throttle valve, and said universal joint being provided at a top with a universal lever, and at a front side with a micrometer head; and an upper base and a supporting plate being screwed to a top and a rear side of said actuating cylinder, respectively.

3. The ink residue lifting and transfer mechanism for screen printing machine as claimed in claim 2, wherein said upper base of said first driving unit is provided at a predetermined position with a fixture for holding a shaft seat thereto.

4. The ink residue lifting and transfer mechanism for screen printing machine as claimed in claim 1, wherein said second driving unit includes an actuating cylinder screwed to a top of a lower base; said actuating cylinder being provided on one lateral side facing toward said first driving unit with a slide way, to which an angle scale holder is mounted for holding an angle scale thereto, and on an opposite lateral side with a universal joint and an air throttle valve, and said universal joint being provided at a top with a universal lever, and at a front side with a micrometer head; and an upper base and a supporting plate being screwed to a top and a rear side of said actuating cylinder, respectively.

5. The ink residue lifting and transfer mechanism for screen printing machine as claimed in claim 4, wherein said upper base of said second driving unit is provided at a predetermined position with a fixture for holding a shaft seat thereto.

6. The ink residue lifting and transfer mechanism for screen printing machine as claimed in claim 1, wherein said first printing pressure cylinders are provided with an adjusting knob each.

7. The ink residue lifting and transfer mechanism for screen printing machine as claimed in claim 1, wherein said second printing pressure cylinders are provided with an adjusting knob each.

8. The ink residue lifting and transfer mechanism for screen printing machine as claimed in claim 1, wherein said ink reclaiming blade holding bar is provided at two end surfaces with an insertion hole each.

* * * * *